US008176962B2

(12) United States Patent
Kilfoyle

(10) Patent No.: US 8,176,962 B2
(45) Date of Patent: May 15, 2012

(54) DOOR BARRIER WITH A PET PORTAL

(76) Inventor: Linda Kilfoyle, Brooks (CA)

( * ) Notice: Subject to any disclaimer, the term of this patent is extended or adjusted under 35 U.S.C. 154(b) by 338 days.

(21) Appl. No.: 12/510,363

(22) Filed: Jul. 28, 2009

(65) Prior Publication Data

US 2011/0023365 A1 Feb. 3, 2011

(51) Int. Cl.
*E06B 3/32* (2006.01)

(52) U.S. Cl. ..... 160/97; 160/180

(58) Field of Classification Search ..... 160/97, 160/180, 368.1, 352; 16/82
See application file for complete search history.

(56) References Cited

U.S. PATENT DOCUMENTS 1,204,833 A * 11/1916 Warfel ..... 160/97
2,093,314 A * 9/1937 MacDonald ..... 160/183
2,311,413 A * 2/1943 Persson ..... 160/20
2,455,112 A * 11/1948 Christison ..... 160/32
4,103,458 A * 8/1978 Booker ..... 49/56
6,164,013 A * 12/2000 Ramsey ..... 49/70
6,550,828 B2 4/2003 Warden
6,761,207 B1 7/2004 Homer
7,165,595 B2 * 1/2007 Yamamoto ..... 160/97
7,207,141 B2 4/2007 Sullivan
2005/0173078 A1 8/2005 Perez, Jr.
2011/0023365 A1 * 2/2011 Kilfoyle ..... 49/70

FOREIGN PATENT DOCUMENTS

WO WO 01/06080 1/2001

* cited by examiner

*Primary Examiner* — Blair M. Johnson
(74) *Attorney, Agent, or Firm* — Maxey Law Offices, PLLC; Stephen Lewellyn

(57) ABSTRACT

A door barrier with pet portal is provided for temporary use and installation with a swing hung door. The door barrier includes a frame positionable within the opening of a door frame, and a flexible barrier extending from the frame that is attachable to a door along an upper and outward edge thereof for extending across the doorway of the door when partially held open. The flexible barrier includes an opening permitting the passage of a pet therethrough.

8 Claims, 6 Drawing Sheets

DOOR BARRIER WITH A PET PORTAL

FIELD OF THE INVENTION

The present invention relates generally to temporary barriers for mounting across a door opening, and more particularly, relating to temporary barrier for mounting across a doorway of a partially open swing hung door including a pet portal for permitting a pet to pass through the doorway.

BACKGROUND OF THE INVENTION

It is desirable to permit pets regular access to outside, such as for example, to a fenced in yard for various reasons. There exists pet doors that are permanently installed on exterior doors that operate to permit a pet to have access to the outside. However, these existing pet doors require modification of the door to which they are installed, including cutting an opening through the door. There are circumstances where cutting an opening through the door is not desired or is not possible due to the type of door, for example french doors. Accordingly, there is a need for a new device that can be temporarily installed in a doorway and which permits passage of a pet.

SUMMARY OF THE INVENTION

The preferred embodiments of the present invention addresses this need by providing a door barrier with a pet portal that is temporary installed in the doorway of a partially open swing hung door without requiring any modification to either the door or the door frame.

To achieve these and other advantages, in general, in one aspect, a door barrier with a pet portal for extending across a doorway of a swing hung door between the door and the door frame for covering the doorway when the door is temporarily held open and allowing egress and ingress of a pet through the doorway, is provided. The door barrier with a pet portal includes a frame adapted to be removably secured to a door frame within the opening thereof and including a horizontal frame member and a vertical frame member. A flexible barrier having a triangular-shaped top panel, a rectangular-shaped vertical panel, a door frame side edge extending along the triangular-shaped top panel and the rectangular-shaped vertical panel, a door side edge extending along the triangular-shaped top panel and the rectangular-shaped vertical panel, and a floor side edge extending along the rectangular-shaped vertical panel, the rectangular-shaped panel having an opening though which a pet may pass. The triangular-shaped top panel extends from the horizontal frame member along the door frame side edge, and the rectangular-shaped vertical panel extends from the vertical frame member along the door frame side edge. The door side edge is removably attachable along the top edge and outward edge of the door.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The accompanying drawings, which are included to provide further understanding of the invention and are incorporated in and constitute a part of this specification, illustrate preferred embodiments of the invention and together with the description serve to explain the principles of the invention, in which.

Similar reference characters denote corresponding features consistently throughout the figures of the drawings.

DETAILED DESCRIPTION OF THE INVENTION

The present invention comprises various embodiments of a door barrier having a pet portal for covering an open doorway or gap of a partially open swing hung door between the door and the door frame while permitting a pet to pass through the door. The embodiments of the present invention are particularly useful for providing a temporary pet door for use with a door that otherwise could not have a permanent pet door installed due to the door construction, for example a french door, or for when installing a permanent pet door is undesirable.

Figure 1:
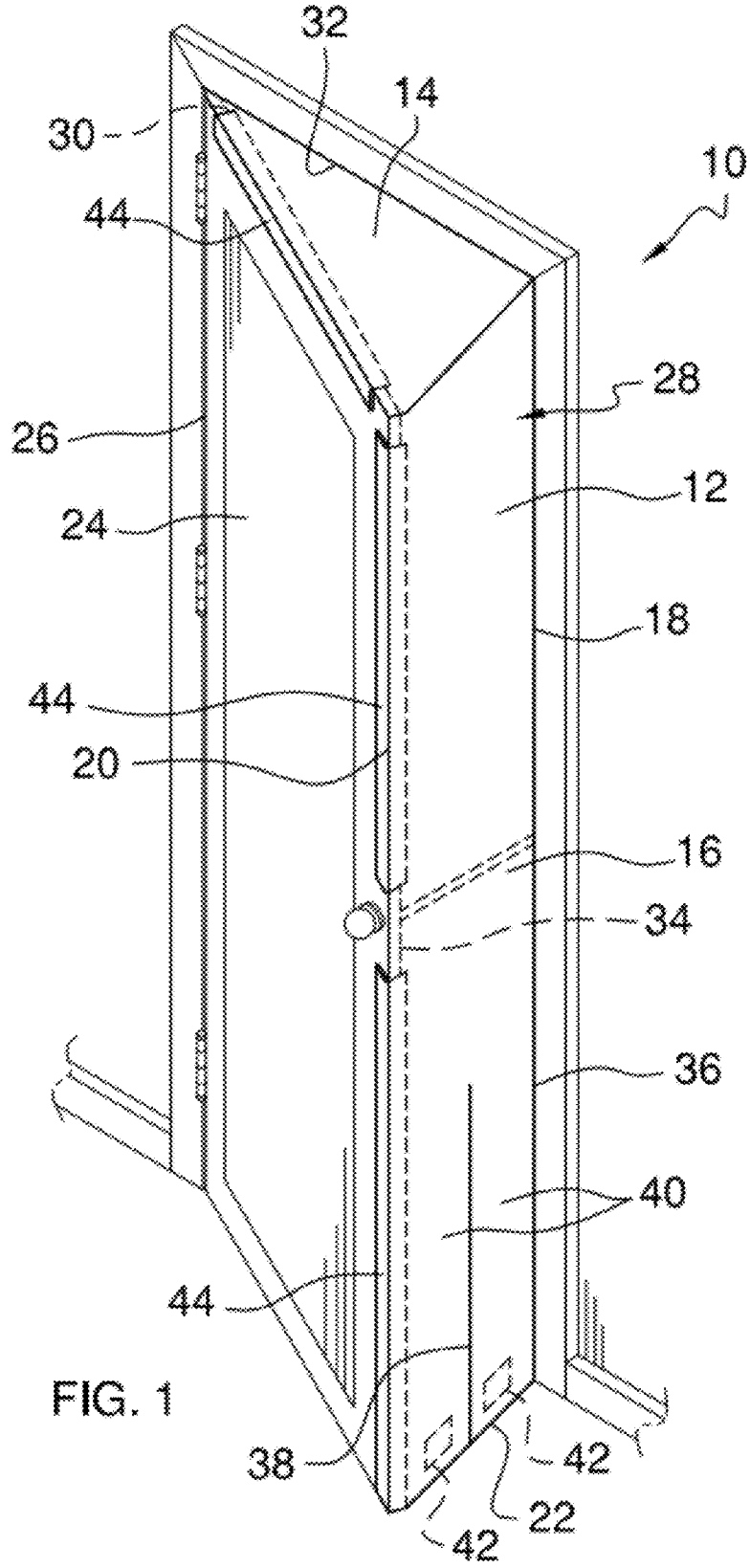
FIG. 1 is an environmental perspective view of a door barrier with pet portal constructed in accordance with the principals of the present invention in-use and from an interior perspective view.

In FIG. 1 of the drawings, there is shown an environmental illustration of a door barrier with a pet portal (door barrier) 10 constructed in accordance with the principals of the present invention in-use and from an interior perspective view. The door barrier 10 includes a flexible barrier 12, which may comprise a fabric material that may or may not be insulating, a plastic material that may or may not be transparent or translucent, an open screen material, or any combinations thereof. The flexible barrier 12 includes a top panel 14 and an vertical panel 16, forming a single barrier sheet. The flexible barrier 12 has a door frame side edge 18 extending along the top panel 14 and the vertical panel 16. An opposite door side edge 20 also extends along the top panel 14 and the vertical panel 16. A floor side edge 22 extends along the vertical panel 16 between the door side edge 20 and the door frame side edge 18.

As shown, the door barrier 10 is designed for use with a swing hung door 24 that is held partially open. The door barrier 10 installed between the door 24 and door frame 26 and extends across the doorway 28 completely covering the doorway between the door and door frame. The top panel 14 is triangular-shaped to correspond to the portion of the doorway 28 defined or extending between the top edge 30 of the door 24 and door frame edge 32. The vertical panel 16 is rectangular-shaped to correspond to the portion of the doorway 28 extending between the outward edge 34 of the door 24 and door frame edge 36.

The vertical panel 16 has an opening such as vertical slit 38 that extends upwardly from the floor side edge 22 forming two flap portions 40. Weights 42 may be attached to the flap portions 40 along the floor side edge 22 to weight the flap portions down and generally maintain the vertical slit in a closed arrangement. An animal may pass through vertical slit 38 to pass across the flexible barrier 12 to egress or ingress through the doorway 28.

The door barrier 10 further includes one or more door edge clamps 44 attached to the flexible barrier 12 along the door side edge 18 thereof for temporarily and removably attaching the flexible barrier at the door side edge thereof to the door 24. More particularly, one or more door edge clamps 44 can be attached to the top panel 14 along the door side edge 18 for securing the door side edge extending along the top panel to the top edge 30 of the door 24. Similarly, one or more door edge clamps 44 can be attached to the vertical panel along the door side 18 for securing the door side edge extending along the top panel to the outward edge 34 of the door 24.

Figure 2:
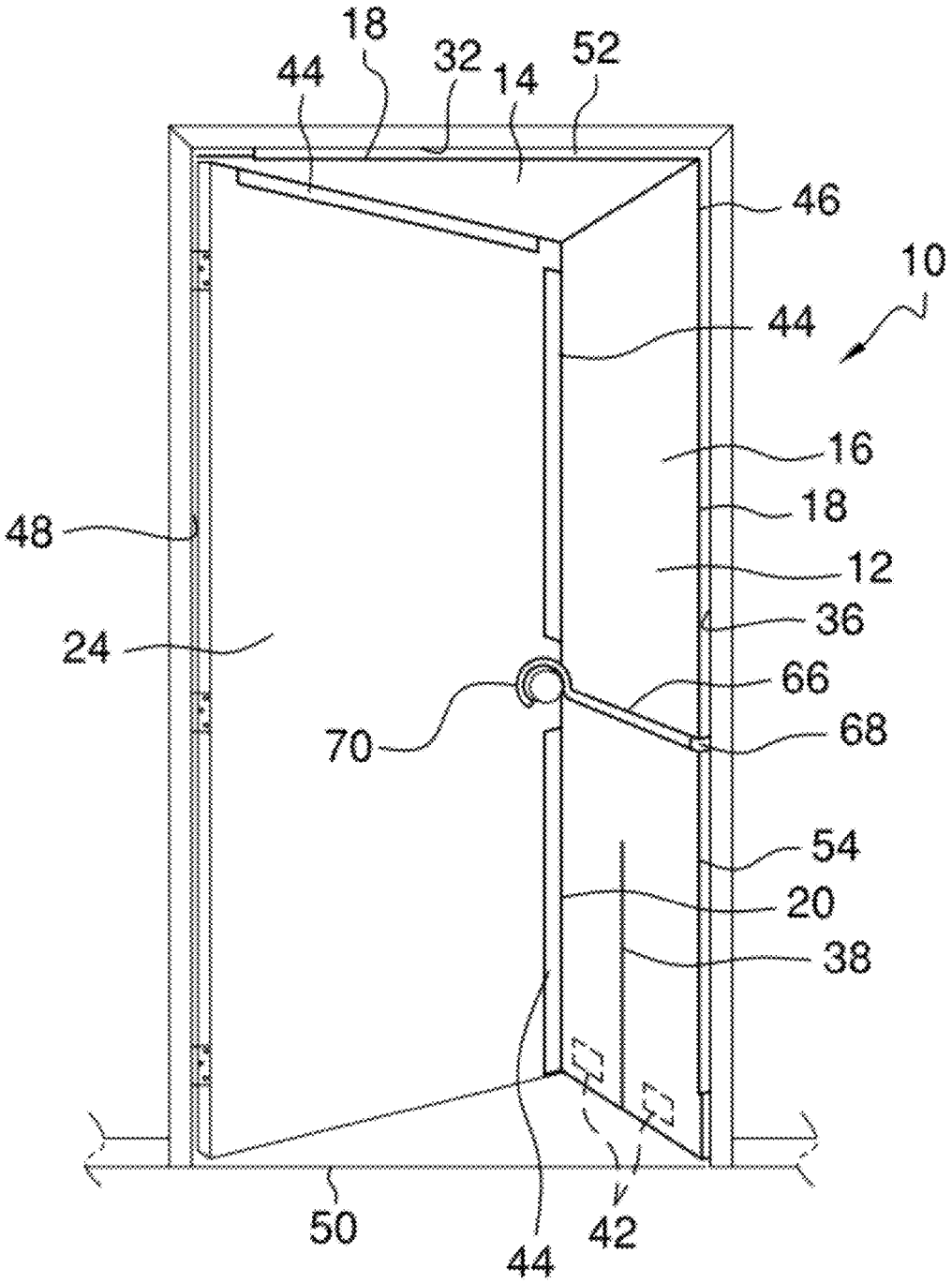
FIG. 2 is an environmental perspective view of the door barrier with pet portal shown in FIG. 1 from an exterior perspective view.

In FIG. 2 of the drawings, there is shown an environmental illustration of the door barrier 10 shown in FIG. 1 from an exterior perspective view. The door barrier 10 includes a frame 46 that is removably positionable and secured to the door frame 26 within the opening thereof defined by vertical jambs or vertical edges 36 and 48, top edge 32 and threshold edge 50. The frame 46 is generally L-shaped and includes a horizontal frame member 52 and a vertical frame member 54. The frame 46 is positioned within the opening of the door frame 26 with the horizontal frame member 52 extending along top edge 32 between vertical edges 36 and 48, and with the vertical frame member 54 extending along vertical edge 36 between top edge 32 and threshold edge 50. The top panel 14 is connected to and extends from the horizontal frame member 52 along the door frame side edge 18, and the vertical panel 16 is connected to and extends from the vertical frame member 54 along door frame side edge.

Figure 3:
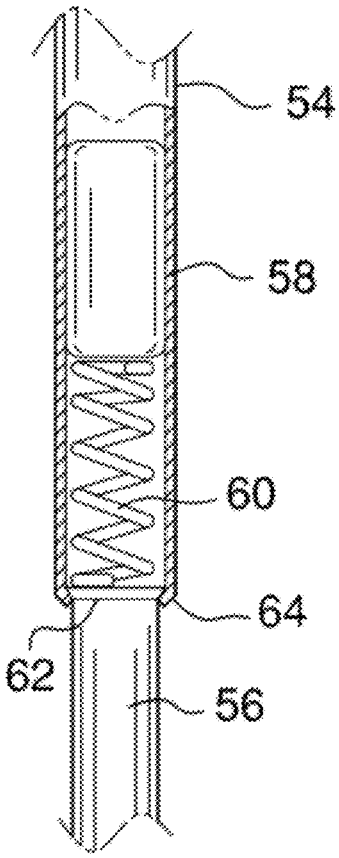
FIG. 3 is a partial cross-sectional view taken though a frame member.

The horizontal frame member 52 and vertical frame member 54 are each extensible and are extended to contact and wedge between vertical edges 36 and 48, and edges 32 and 50 of the door frame 26, respectively. In FIG. 3, there is shown a partial cross-section taken though the vertical frame member 54. The horizontal frame member 52 is similarly constructed and therefore discussion with reference to the vertical frame member 54 is sufficient for understanding. The vertical frame member 54 includes a first elongated frame member 56 telescopically received by a second elongated frame member 58 for reciprocation therewith. Frame member 56 may be spring biased by spring 60 in a direction outwardly of frame member 58. Ends 62 and 64 of frame members 56 and 58, respectively, may be rolled to prevent complete withdrawal of frame member 56 from frame member 58. Alternatively, it is well known in the art that end 64 could be fitted with a compression nut which when tightened would clamp frame member 56 and prevent it from telescoping relative to frame member 58.

With reference back to FIG. 2, the door barrier 10 can further include a door stop 66 for holding the door 24 partially open forming doorway 28. The door stop 66 is an elongated bar-like member connected at end 68 to the frame 46 generally at vertical frame member 54 and extends generally horizontally therefrom. End 70 of the door stop 66 is engagable with the door 24, for example at door handle or knob 72 to hold the door open. End 70 can be hook-shaped to slide over and between the door 24 and the door knob 72 to hold the door open. Door stop 66 can be extensible to adjust the width of doorway 28.

Figure 4:
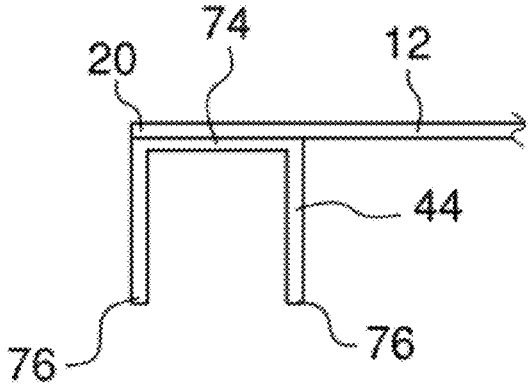
FIG. 4 is a partial cross-sectional view taken through a door clamp.

In FIG. 4 there is shown a partial cross-section of the door barrier 10 taken through a door clamp 44. In a non-limiting example, the door clamp 44 can include a door edge covering portion 74 and a pair of door side clamp portions 76 extending outwardly from the door edge covering portion at opposite edges thereof. The flexible barrier 12 is attached at door side edge 20 to the door clamp 44, for example along the door edge covering portion 74. The above description should be considered as a non-limiting example of door clamp 44, as many different clamp constructions including hooks can be utilized in attaching the door side edge 20 of the flexible barrier 12 to the door 24.

Figure 5:
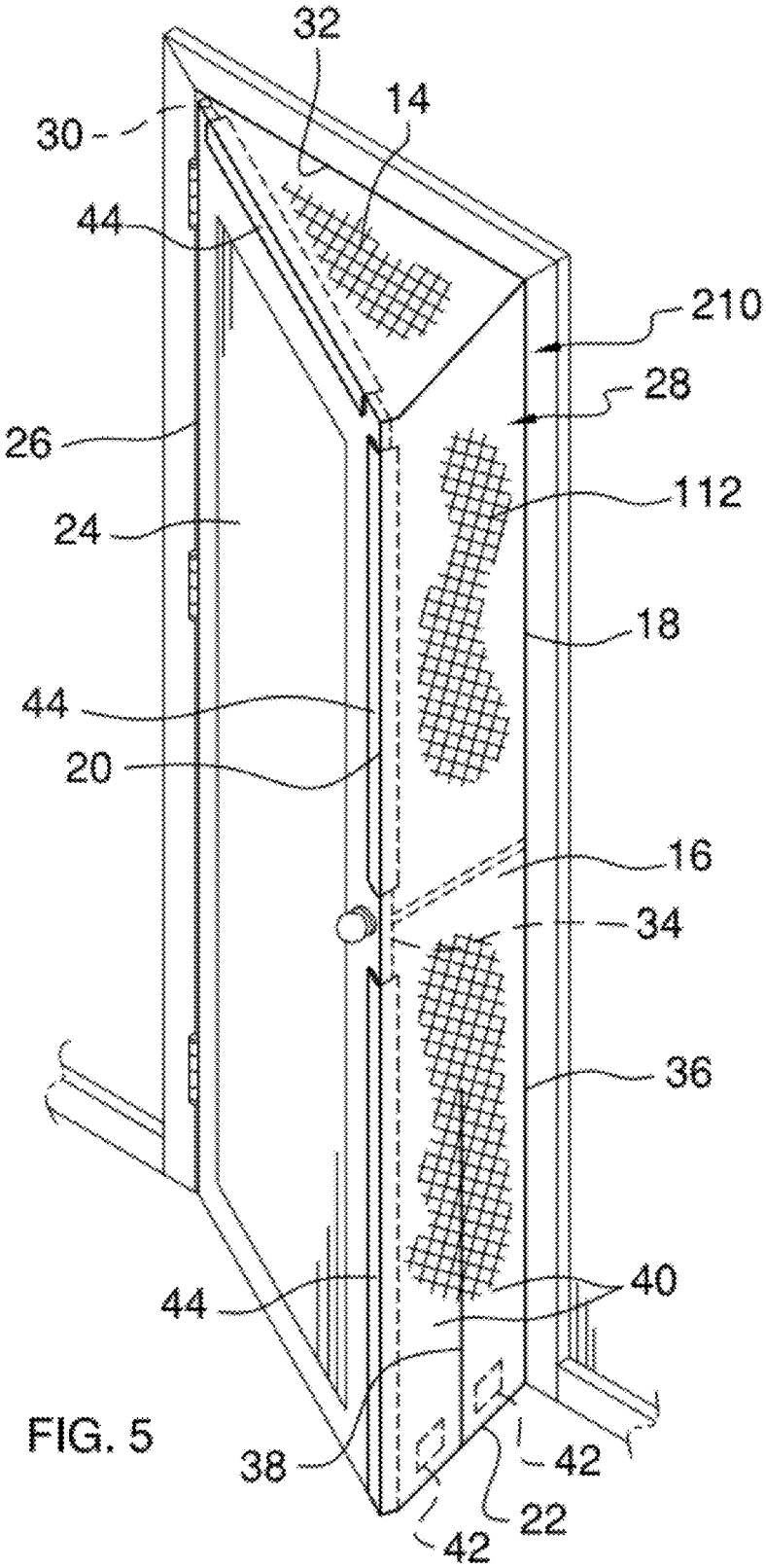
FIG. 5 is a is an environmental perspective view of an alternate embodiment of a door barrier including a flexible barrier of a mesh screen.

In FIG. 5, there is shown an alternative embodiment of a door barrier constructed in accordance with the principals of the present invention, designated as door barrier 110. Door barrier 110 includes most of the features of the door barrier 10 illustrated in FIGS. 1-4 and described in detail above, with similar features retaining the same reference numbers. In door barrier 110, the flexible barrier 12 of door barrier 10 is replaced with flexible barrier 112 of an open mesh screen. The flexible barrier 112 can be formed of a fine mesh screen, as in a window screen or the like.

Figure 6:
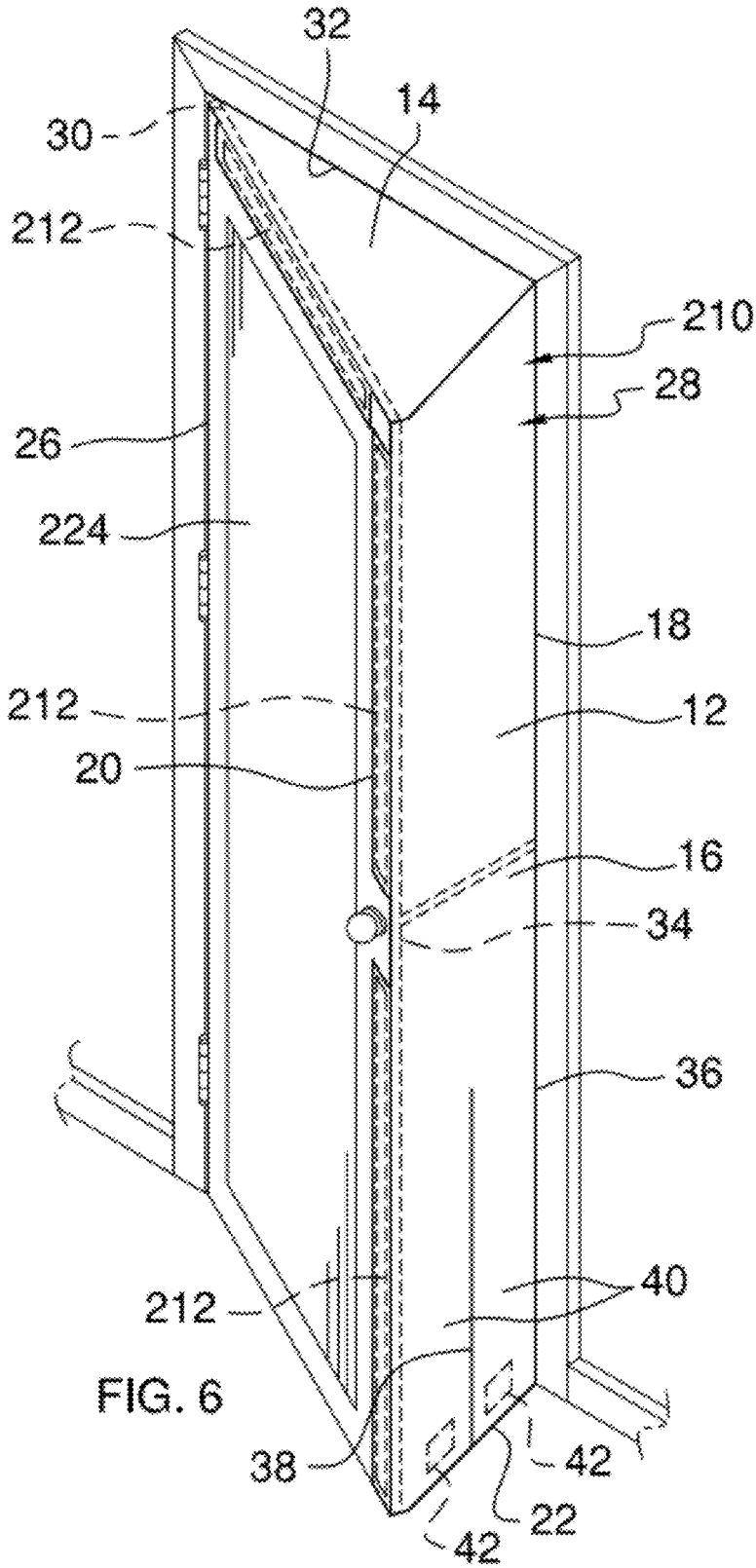
FIG. 6 is an environmental perspective view of an alternate embodiment of a door barrier including magnetic attachment strips.

In FIG. 6, there is shown yet another alternative embodiment of a door barrier constructed in accordance with the principals of the present invention, designated as door barrier 210. Door barrier 210 includes most of the features of the door barrier 10 illustrated in FIGS. 1-4 and described in detail above, with similar features retaining the same reference numbers. In door barrier 210, the door clamps 44 are replaced by one or more magnetic attachment strips 212. The flexible barrier 214 of door barrier 210 can also be the flexible barrier 112 of an open mesh screen of FIG. 5. As shown here, one or more magnetic attachment strips 212 are attached to the flexible barrier 214 along door side edge 220 of the flexible barrier. The magnetic attachment strips 212 are magnetically attractable to a ferrous metal door, such as door 224, and permit the flexible barrier 214 to be temporary and removably attached to the door along door side edge 220.

Figure 7:
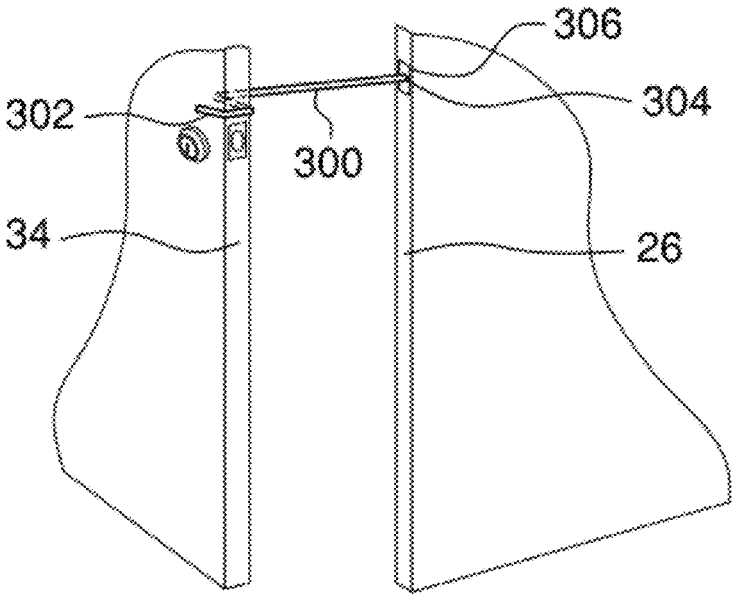
FIG. 7 is an environmental perspective view of an alternate embodiment of a door stop.

In FIG. 7, there is shown a door stop 300 that is an alternative to door stop 66 as shown in FIGS. 1-6 and described above. Door stop 300 is separate and not attached to the frame 46. Door stop 300 has end 302 that is engagable with door edge 34 and a second opposed end 304 that is engagable with a striker plate 306 of the door frame 26.

Figure 8:
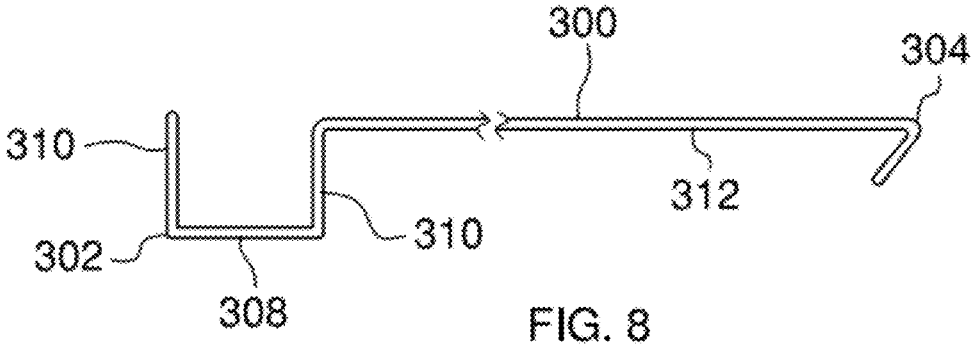
FIG. 8 is a top plan view of the door stop of FIG. 7.

In FIG. 8, door stop end 302 includes door edge portion 308 and door side clamp portions 310 extending outwardly from the door edge portion at opposite edges thereof. Door stop end 304 can be hooked shaped to hook onto an edge of a door frame striker plate or other suitable door frame edge portion. Elongated bar portion 310 extends between ends 302 and 304.

The use and operation of the embodiments of the present invention is apparent from the above detailed description and accordingly, not further description relative to the use and operation need be provided.

A number of embodiments of the present invention have been described. Nevertheless, it will be understood that various modifications may be made without departing from the principals and concept of the present invention invention. Accordingly, other embodiments are within the scope of the following claims.

What is claimed is:

1. A door barrier with a pet portal for extending across a doorway of a swing hung door between the door and the door frame for covering the doorway when the door is temporarily held open and allowing egress and ingress of a pet through the doorway, the door barrier with a pet portal comprising:

a frame adapted to be removably secured to a door frame within the opening thereof and including a horizontal frame member and a vertical frame member;

a flexible barrier having a triangular-shaped top panel, a rectangular-shaped vertical panel, a door frame side edge extending along said triangular-shaped top panel and said rectangular-shaped vertical panel, a door side edge extending along said triangular-shaped top panel and said rectangular-shaped vertical panel, and a floor side edge extending along said rectangular-shaped vertical panel, said rectangular-shaped panel having an opening though which a pet may pass;

wherein said triangular-shaped top panel extends from said horizontal frame member along said door frame side edge, and said rectangular-shaped vertical panel extends from said vertical frame member along said door frame side edge;

wherein said door side edge is removably attachable along the top edge and outward edge of the door; and a door stop member extending horizontally from said vertical frame member and across said rectangular-shaped vertical panel at a position above said opening and engagable with the door to hold the door open.

2. The door barrier with a pet portal of claim 1, wherein said door stop member comprising and elongated bar having one end attached to said vertical frame member and an opposite end engagable with a door handle.

3. The door barrier with a pet portal of claim 1, wherein said opening is a vertical slit extending from said floor side edge.

4. The door barrier with a pet portal of claim 1, wherein said horizontal frame member is extensible in length and comprises a first elongated member telescopically received by a second elongated member, and wherein said vertical frame member is extensible in length and comprises a first elongated member telescopically received by a second elongated member.

5. The door barrier with a pet portal of claim 1, further comprising:

a door clamp along said door side edge, and wherein said door side edge is removably attachable along the top edge and outward edge of the door by said door clamp removably engaging the door.

6. The door barrier with pet portal of claim 1, further comprising:

a magnetic member along said door side edge, and wherein said side edge is removably attachable along the top edge and outward edge of the door by said magnetic member removably engaging the door.

7. The door barrier with pet portal of claim 1, wherein said flexible barrier comprises a mesh screen material.

8. The door barrier with pet portal of claim 1, wherein said flexible barrier comprises an insulating fabric material.

* * * * *